US008196527B2

(12) United States Patent
Linares

(10) Patent No.: US 8,196,527 B2
(45) Date of Patent: Jun. 12, 2012

(54) COMPOSITE STACKABLE PALLET CONSTRUCTION

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 467 days.

(21) Appl. No.: 12/414,017

(22) Filed: Mar. 30, 2009

(65) Prior Publication Data

US 2009/0241461 A1 Oct. 1, 2009

Related U.S. Application Data

(60) Provisional application No. 61/040,228, filed on Mar. 28, 2008.

(51) Int. Cl.
*B65D 19/38* (2006.01)

(52) U.S. Cl. ..... 108/57.25; 108/51.3; 108/55.5

(58) Field of Classification Search ..... 108/57.25, 108/51.3, 57.26, 57.27, 57.28, 57.34, 51.11, 108/55.1, 55.5, 901, 902; 248/346.02; 206/386, 206/600, 595, 598
See application file for complete search history.

(56) References Cited

U.S. PATENT DOCUMENTS

| | | | | | |
|---|---|---|---|---|---|
| 2,709,559 | A | * | 5/1955 | Geisler | 108/51.3 |
| 2,913,206 | A | * | 11/1959 | Paris | 108/51.3 |
| 3,580,190 | A | * | 5/1971 | Fowler | 108/57.25 |
| 3,664,272 | A | | 5/1972 | Sanders | |
| 3,675,595 | A | * | 7/1972 | Sullivan | 108/57.28 |
| 3,710,733 | A | * | 1/1973 | Story | 108/57.28 |
| 3,814,778 | A | * | 6/1974 | Hosoda | 108/57.28 |
| 3,832,955 | A | | 9/1974 | Pottinger et al. | |
| 3,955,613 | A | | 5/1976 | Lund | |
| 4,597,338 | A | | 7/1986 | Kreeger | |
| 4,715,294 | A | | 12/1987 | Depew | |
| 4,829,909 | A | * | 5/1989 | Mandel | 108/55.5 |
| 4,843,976 | A | | 7/1989 | Pigott et al. | |
| 4,931,340 | A | | 6/1990 | Baba et al. | |
| 5,082,712 | A | | 1/1992 | Starp | |
| 5,143,778 | A | | 9/1992 | Shuert | |
| 5,205,221 | A | * | 4/1993 | Melin et al. | 108/51.3 |
| 5,365,858 | A | * | 11/1994 | Kuhns | 108/55.3 |
| 5,401,456 | A | | 3/1995 | Alesi, Jr. et al. | |
| 5,423,428 | A | | 6/1995 | Selz | |
| 5,473,995 | A | | 12/1995 | Gottlieb | |
| 5,579,686 | A | | 12/1996 | Pigott et al. | |
| 5,687,652 | A | * | 11/1997 | Ruma | 108/57.25 |
| 5,709,913 | A | | 1/1998 | Andersen et al. | |
| 5,868,080 | A | * | 2/1999 | Wyler et al. | 108/57.25 |
| 5,890,437 | A | | 4/1999 | Hill | |
| 6,294,114 | B1 | | 9/2001 | Muirhead | |
| 6,357,364 | B1 | | 3/2002 | Maloney et al. | |
| 6,357,366 | B1 | * | 3/2002 | Frankenberg | 108/57.25 |
| 6,524,426 | B1 | | 2/2003 | St. John et al. | |

(Continued)

FOREIGN PATENT DOCUMENTS

| | | | |
|---|---|---|---|
| JP | 02139341 | A | 5/1990 |

(Continued)

*Primary Examiner* — Jose V Chen
(74) *Attorney, Agent, or Firm* — Gifford, Krass, Sprinkle, Anderson & Citkowski, P.C.

(57) ABSTRACT

A structurally reinforcing and three dimensional article, such as a pallet, having a structural insert of specified shape and size. A composite plasticized material is over-molded or otherwise applied upon the structural insert according to a selected thickness to encapsulate the insert. The pallets are stackable when not in use and may also include built in straps for securing cargo thereupon.

13 Claims, 12 Drawing Sheets

U.S. PATENT DOCUMENTS

| | | | | |
|---|---|---|---|---|
| 6,569,509 | B1 | 5/2003 | Alts | |
| 6,598,541 | B2 | 7/2003 | Vilkki | |
| 6,655,299 | B2 * | 12/2003 | Preisler et al. | 108/51.3 |
| 6,705,237 | B2 * | 3/2004 | Moore et al. | 108/57.25 |
| 6,745,703 | B2 | 6/2004 | Torrey et al. | |
| 6,863,003 | B2 | 3/2005 | Grainger | |
| 6,938,559 | B2 | 9/2005 | Wullenweber | |
| 6,954,982 | B2 | 10/2005 | Isle et al. | |
| 6,972,144 | B2 | 12/2005 | Roth et al. | |
| 7,013,814 | B2 * | 3/2006 | Modesitt et al. | 108/51.3 |
| 7,197,989 | B2 | 4/2007 | Apps | |
| 7,469,643 | B2 | 12/2008 | Isle et al. | |
| 7,726,248 | B2 * | 6/2010 | Shuert | 108/57.25 |
| 7,804,400 | B2 * | 9/2010 | Muirhead | 340/505 |
| 7,819,068 | B2 * | 10/2010 | Apps et al. | 108/53.3 |
| 2002/0007770 | A1 | 1/2002 | Vilkki | |
| 2002/0106483 | A1 | 8/2002 | Obeshaw | |
| 2002/0148393 | A1 | 10/2002 | Milles | |
| 2003/0024443 | A1 | 2/2003 | Hoshi | |
| 2003/0041956 | A1 | 3/2003 | Pigott et al. | |
| 2003/0070594 | A1 | 4/2003 | Isle et al. | |
| 2003/0136315 | A1 | 7/2003 | Kim | |
| 2003/0189152 | A1 | 10/2003 | Elder et al. | |
| 2004/0007164 | A1 | 1/2004 | Herring et al. | |
| 2004/0187745 | A1 | 9/2004 | Rojas et al. | |
| 2005/0076816 | A1 | 4/2005 | Nakano | |
| 2005/0211139 | A1 * | 9/2005 | Perrotta et al. | 108/57.25 |
| 2005/0241548 | A1 | 11/2005 | Muirhead | |
| 2006/0003044 | A1 | 1/2006 | DiNello et al. | |
| 2006/0075939 | A1 * | 4/2006 | Shuert | 108/57.25 |
| 2006/0130712 | A1 * | 6/2006 | Wang | 108/57.25 |
| 2006/0144301 | A1 | 7/2006 | Borggaard | |
| 2006/0288915 | A1 | 12/2006 | Kulbeth et al. | |
| 2007/0215014 | A1 | 9/2007 | Lee | |
| 2007/0283857 | A1 | 12/2007 | Dong | |
| 2008/0053596 | A1 | 3/2008 | Davies et al. | |
| 2008/0060561 | A1 | 3/2008 | Carrasco | |
| 2008/0098935 | A1 | 5/2008 | Roth et al. | |
| 2008/0103944 | A1 | 5/2008 | Hagemann et al. | |
| 2008/0110377 | A1 | 5/2008 | Stevens | |
| 2008/0156234 | A1 | 7/2008 | van de Camp | |
| 2008/0210140 | A1 | 9/2008 | Valentinsson | |

FOREIGN PATENT DOCUMENTS

| | | | |
|---|---|---|---|
| JP | 03029744 | A | 2/1991 |
| JP | 06156493 | A | 6/1994 |
| JP | 06-235780 | A | 8/1994 |
| JP | 08034014 | A | 2/1996 |
| JP | 08034438 | A | 2/1996 |
| JP | 08336866 | A | 12/1996 |
| JP | 11079180 | A | 3/1999 |
| JP | 11221828 | | 8/1999 |
| JP | 2001-328632 | A | 11/2001 |
| JP | 2002166940 | A | 6/2002 |
| JP | 2003011969 | A | 1/2003 |
| JP | 2003-034330 | A | 2/2003 |
| JP | 2003-267370 | A | 9/2003 |
| JP | 2004090988 | A | 3/2004 |
| JP | 2005104562 | A | 4/2005 |
| JP | 2006036315 | A | 2/2006 |
| JP | 2006036331 | A | 2/2006 |
| JP | 2006298403 | A | 11/2006 |
| JP | 2008023741 | A | 2/2008 |
| JP | 2008087839 | A | 4/2008 |
| KR | 20030034370 | A | 5/2003 |
| KR | 10-0577441 | | 5/2006 |
| KR | 1020090117107 | | 11/2009 |
| WO | WO-2006082595 | A1 | 8/2006 |

* cited by examiner

COMPOSITE STACKABLE PALLET CONSTRUCTION

CROSS-REFERENCE TO RELATED APPLICATIONS

This Application claims the benefit of U.S. Provisional Application 61/040,228 filed on Mar. 28, 2008 and entitled Composite Stackable Pallet Construction.

FIELD OF THE INVENTION

The present invention is directed to a composite stackable pallet construction for providing heavy duty support. A structural spine or insert (such as a heavy duty paperboard corrugated material or galvanized insert) is supported within a mold and about which is injection molded or otherwise formed a fire/heat proof composite thermoset or composite thermoplastic material. The pallet construction can be solid, however can also encompass interiorly extending open apertured locations, these further reducing the overall weight of the pallet without compromising its strength. Additional features include a radio frequency identification (RFID) tag for providing wireless information associated with the materials supported upon the pallet. Other features include surface configurations associated with opposing surfaces of stackable pallets, and to provide an enhanced degree of multiple stackability, as well as the provision of hold down strap engagement locations associated with the sides of the pallet to better secure items supported thereupon.

BACKGROUND OF THE INVENTION

Transport and support pallet assemblies are known in the relevant art and which are provided for supporting varying sized loads during storage or transport. Such pallet assemblies can include such as wooden or plastic construction and can further exhibit multi-piece construction.

SUMMARY OF THE INVENTION

A structurally reinforcing and three dimensional article, such as a pallet, having a structural insert of specified shape and size. A composite plasticized material is over-molded or otherwise applied upon the structural insert according to a selected thickness to encapsulate the insert. The pallets are stackable when not in use and may also include built in straps for securing cargo thereupon.

Additional features include the pallet exhibiting a plurality of intermediately positioned, spaced apart and elongate extending ribs exhibiting a desired cross sectional configuration, a plurality of open channels being interiorly defined within the article between said ribs. Also shown is a plurality of edge or corner defined mating locations, these established between upper and lower surfaces of each pallet, such that a second identically configured pallet is capable of being seated in supporting fashion upon a first pallet.

Additional features associated with the structural insert include it exhibiting a specified shape and size and being constructed of any of a galvanized steel, corrugated paperboard, or like rigid and structurally supporting material. The composite material can further include any of a heat/fire thermosetting or a thermoplastic material. Additional variants contemplate an aggregate material entrained or otherwise mixed within the plasticized material.

The pallet may also include engageable forklift apertures defined in side locations as well as attachable strap locations for hold-down of supported items. Associated straps can extend and be engaged in both width-wise and end-wise extending fashion along selected side edges associated with the pallet. An edge extending upper rim can also be associated with the upper surface of the pallet for providing an additional element of positional support to items placed thereupon. The pallet can also include at least one extending and raised lip extending along each side thereof.

Other and additional features can include the pallet incorporating a radio frequency protocol identification chip either in-molded or secured to a respective location along an edge thereof. An alternate variant contemplates the pallet redesigned as a substantially planar shaped article operating as a panel and exhibiting edge extending interlock portions for erecting a height/width extending wall. The wall panel can further exhibit a textured faux ceramic or like design feature.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
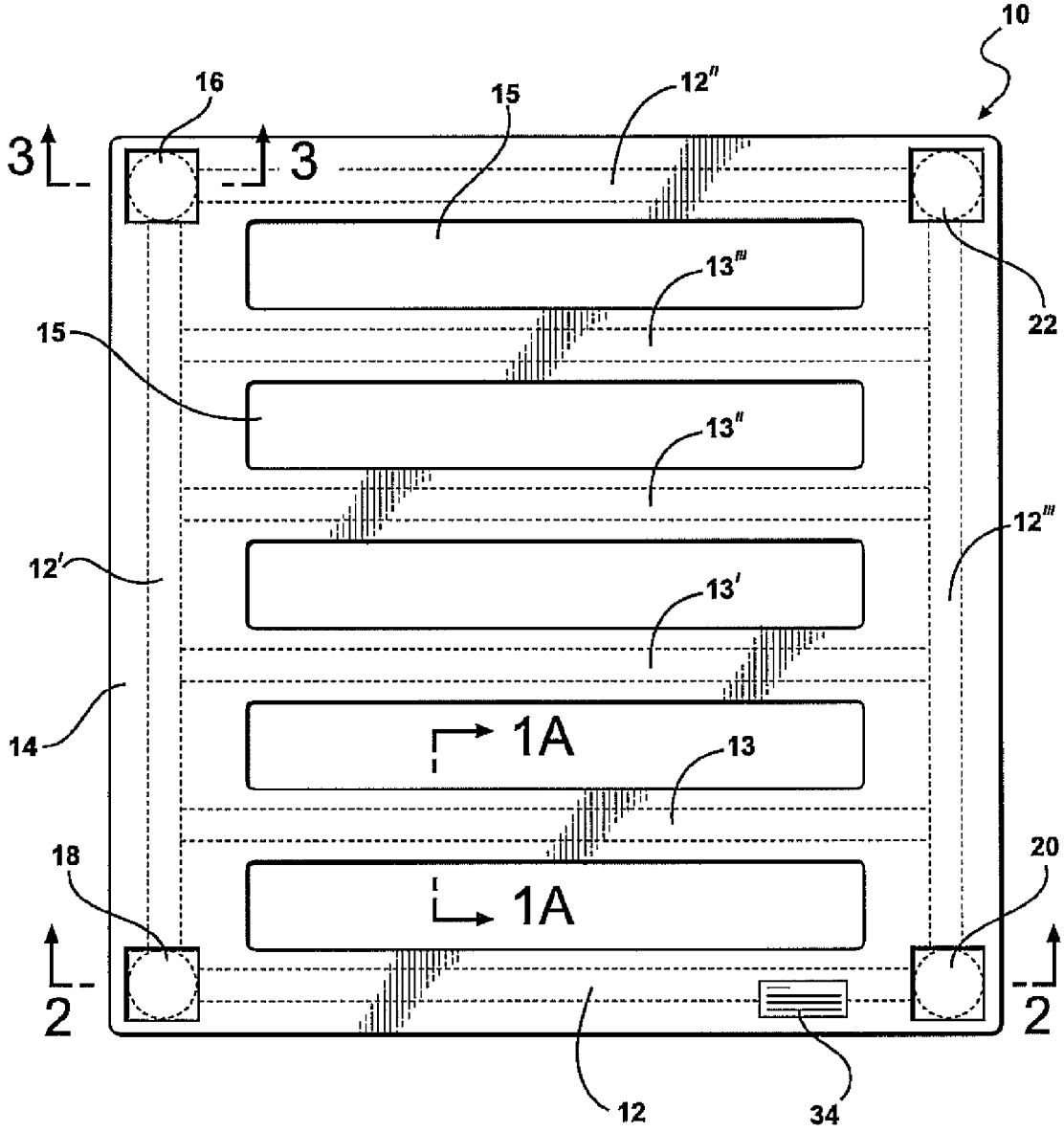
FIG. 1 is a top plan view of a selected composite stackable pallet construction according to a preferred embodiment of the present inventions.

Referring now to FIG. 1, a top plan view is shown at 10 of a selected composite stackable pallet construction according to a first preferred embodiment of the present inventions. As previously described, the stackable pallet construction is designed so as to provide heavy duty support of items located thereupon and exhibits, according to the selected variant, a structural spine or insert (such as a heavy duty paperboard corrugated material or galvanized insert) which operates to greatly enhance the strength of the pallet assembly in supporting heavier loads set thereupon.

As will be further described in detail, the manner of constructing the structural pallet article is such that the inner structural supporting insert is placed within a mold cavity, or other manufacturing medium associated with the creation of the pallet article, and about which is injection molded or otherwise formed a fire/heat proof composite thermoset or composite thermoplastic material. As will be further described, the completed pallet article can be solid, however can also encompass interiorly extending open apertured locations, recesses or other configurations, these further reducing the overall weight of the pallet without compromising its strength. The underside of each pallet can further exhibit linear width and/or length extending recesses, and which are designed to seat inserting forks associated with a conventional forklift machine.

Additional features include a radio frequency identification (RFID) tag for providing wireless information associated with the materials supported upon each pallet. Other features include mating and alternating surface configurations associated with each pallet, these creating in combination opposing surfaces for effectively stacking the pallets in multiple fashion. Also disclosed is the provision of hold down straps and associated strap engagement locations associated with the side edges of the pallet body, these being provided to better secure items supported thereupon.

As will also be described, an additional variant of the pallet construction contemplates a plasticized and main pallet body with optional attachable bottom section, these sandwiching therebetween the galvanizing insert and cross shaped reinforcing support for further increasing the load supporting and weight distributing ability of the pallet. The main plasticized body incorporates a reinforcing and honeycombed corrugated insert which greatly enhances the load supporting aspects of the design.

Figure 3:
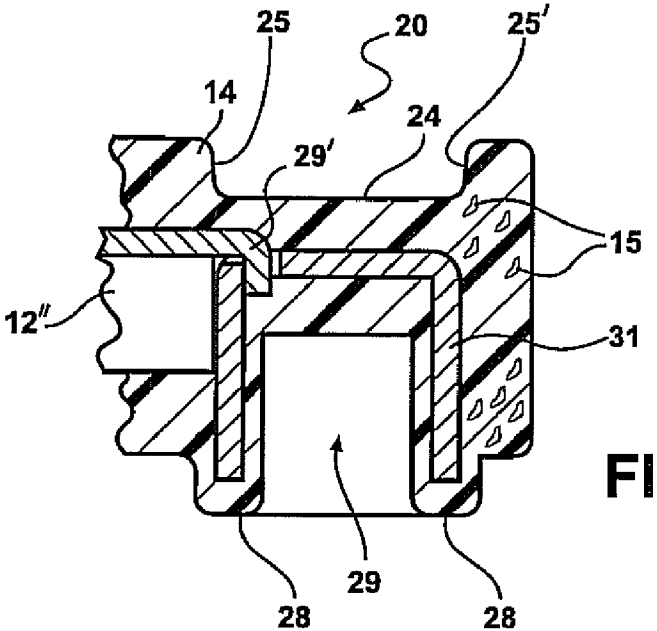
FIG. 3 is an enlarged selected corner view of the pallet in FIG. 1 and illustrating the configuration of the structurally strengthened insert, in particular exhibiting a generally perimeter extending cup shape, or elongated lengthwise rail shape, and about which the composite plastic material is formed for establishing upper/lower interlocking of stacked pallets.
Figure 1A:
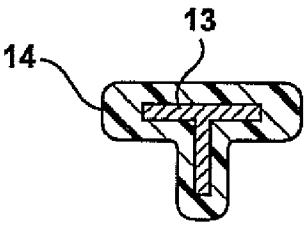
FIG. 1A is a cutaway view taken along 1A-1A in FIG. 1 and showing a cross sectional configuration of a selected lengthwise rib associated with the pallet construction.
Figure 2:
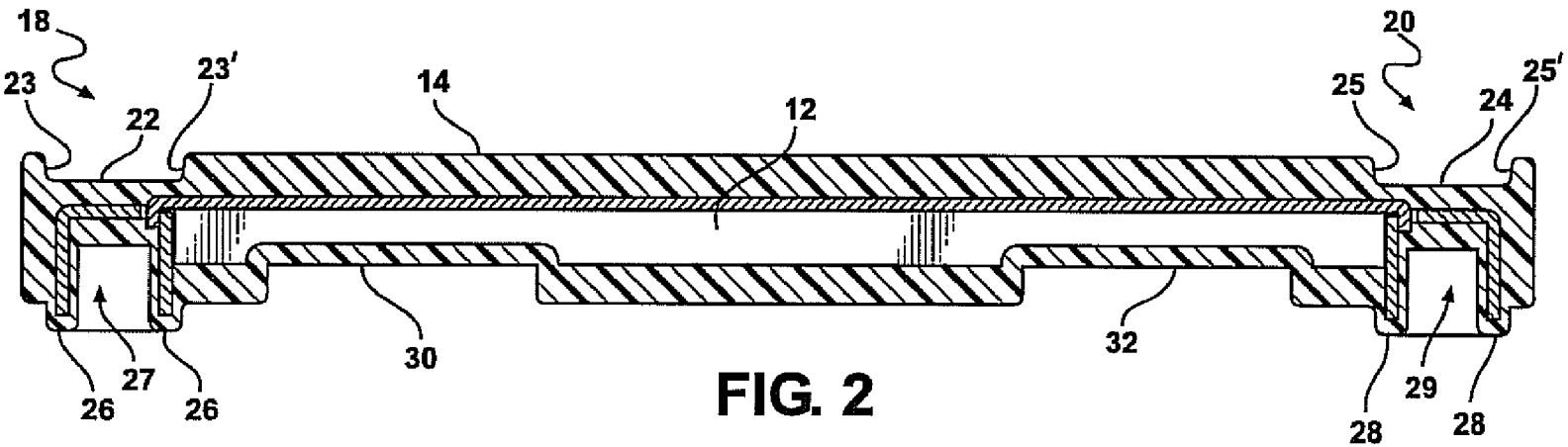
FIG. 2 is a rotated side cutaway view of the pallet taken along the modified cutaway line 2-2 in FIG. 1 and further showing the features of the galvanized insert and upper/lower surface configurations for enhancing stackability, as well as underside configured forklift support locations.

The above said, and referencing again FIG. 1 in cooperation with FIGS. 1A, 2 and 3, the pallet construction includes a structural substrate (or insert) such as galvanized steel 12 about which is applied a plasticized coating 14 of selected thickness. As best shown in FIG. 1, the insert exhibits a generally overall square or rectangular shape with a first plurality of interconnecting outer members 12, 12', 12", 12''' and a further plurality of parallel and spaced apart members 13, 13', 13", 13''' extending between selected and parallel spaced members 12' and 12'''. The support configuration exhibited by the various interconnecting structural members 12, 12', 12", 12''' and 13, 13', 13", 13''' can be further modified such as by incorporating an additional and crosswise extending plurality of structural members (not shown) and such as to impart a more overall grid shape to the overall assembly.

Accordingly, and comparing again the illustrations of FIGS. 1, 1A, 2 and 3, it is again evident that the substrate/insert can exhibit any shape or configuration however, and in the embodiment illustrated, exhibits a generally four sided construction with central extending and spaced apart ribs, these in combination with corner disposed configurations for facilitating stackability and as will be further described.

As further evident from FIG. 1A, a cutaway is shown of a selected intermediate extending member (or rib) at 13 and exhibiting a substantially "T" shape in configuration. It is understood that other cross sectional cutaway configurations can also be provided alternative to the selected "T" shape illustrated, these potentially including other open or closed polygonal cross sectional shapes (not shown). In this fashion, the plurality of the crosswise supporting members/ribs 13, 13', 13", 13''' are separated by open spaces, such as which are defined by lengthwise extending apertures each established by closed inner defining perimeter edges (at 15 in FIG. 1), the inner perimeter edges shown in FIG. 1 each further corresponding in dimension to a desired spacing between selected crosswise supporting members, in combination with an applied thickness of the plasticized/polymeric material applied or otherwise over-molded upon the insert.

The structural insert can also include, as will be referenced in subsequent embodiments, such as a heavy duty and corrugated paperboard material. Other materials, such as a natural bamboo-like material or the like can also be substituted for providing the necessary properties of strength and durability when utilized in combination with a composite plastic overmold.

Although not shown, a preferred manufacturing process contemplates placing the desired structural (galvanized) insert (again including perimeter interconnecting members 12, 12', 12", 12''' and crosswise connecting members 13, 13', 13", 13''') into a mold cavity, following which a volume of a composite plasticized (including both a heat/fireproof thermoset or a thermoplastic) material is injected or otherwise formed about the insert according to a desired thickness (such as ranging anywhere from a fraction of an inch upwards). Any of a number of molding processes is contemplated for mixing and forming the thermoplastic/thermosetting materials, collectively referenced at 14 in FIGS. 1-3, about the structural configured substrate/insert 12, such also contemplating utilizing a powder impression material in cooperation with either a natural or synthetic aggregrate (see as shown at 15 in FIG. 3) and which is entrained or otherwise intermixed within the matrix or soup material which is subsequently formed or otherwise applied about the skeletal rectangular shape achieved by the interconnecting outer members 12, 12', 12", 12''' and inner interconnecting members (e.g. ribs) 13, 13', 13", 13''' according to the desired thickness.

A plurality of mating locations are established between upper and lower respective surfaces of each of the pallets 10 and includes, in the initial illustrated embodiment, includes a series of four corner seating locations, and which are generally referenced in FIG. 1 at 16, 18, 20 and 22. As further shown in the rotated cutaway view of FIG. 2, when viewed in combination with FIG. 1 and the further sectional cutaway of FIG. 3, each of the corner seating locations (as shown by example at 18 and 20 in FIG. 2) each exhibit an upper facing and closed polygonal shaped recess configuration (e.g. square in the illustrated variant). These are further respectively shown as recessed surfaces 22 and 24, respectively, and each closed polygonal (e.g. square) shaped recess is further defined by a plurality (in this instance four apiece) of upwardly extending and recess defining walls, see further at 23, 23" and 25, 25" in FIG. 2, respectively for recessed surfaces 22 and 24. The preferred variant also contemplates the corner locations Her including a single lengthwise extending and recessed channel in a generally rectangular shape, however it is also envisioned that each corner location (e.g. again at 16, 18, 20 and 22) can also exhibit an individual and more generally square shape corner profile.

Opposite undersides of each corner location further exhibit downwardly projecting and likewise polygonal (e.g. lengthwise extending rectangular or isolated corner square) seating portions, see underside accessible wall edges shown at 26 and 28 and which reveal an open and likewise square shaped pocket (at 27 and 29 in FIGS. 2 and 3). The outer interconnecting edges 26 and 28 around the pockets are dimensioned so that they seat therein the inner recessed and upper facing perimeter (22, 23, 23' and 24, 25, 25') associated with each of the upper recess configurations (again at 22 and 24) and to provide secure and reliable stacking of multiple pallets when not in use.

The structural insert can further exhibit a likewise polygonal and inner disposed profile approximate each corner location, see as best shown in the enlarged sectional view of FIG. 3. The configuration of the corner located structural insert portions is further such that they each generally replicate a downwardly facing rail or enclosed cup shape (depending upon the desired variant) and about which is formed a desired layering of polymeric composite matrix. Also referenced at 29' in FIG. 3 is a reinforcing connection between the main insert 12 and a selected galvanized insert cup or rail location, further at 31, this further provides the edge or corner locations with the requisite durability to withstand the loading forces associated with the stacking of a large number of pallets during storage, and in addition to the ability to easily locate and seat successive pallets one atop the other.

Additional features include the configuration of underside configured forklift support locations, see lengthwise extending recesses 30 and 32 in FIG. 2. In this fashion, an equally spaced pair of forks (not shown) associated with a conventional forklift machine are engeable with a lower-most positioned pallet construction 10, and by which the forklift (not shown) can easily and efficiently elevate any selected number of pallets, and which may be support upon lower-most desired pallet exhibiting such fork seating locations.

Yet additional features include the provision of a radio frequency identification device (or Rfid tag) 34, this being secured, mounted or otherwise in-molded into the body of the pallet 10, and such as for example upon or within an associated side surface. The use of Rfid (also termed as Radio Frequency Identification) tags is known in the art and issues a digital signal to an external reader, such as in order to identify the contents of pre-registered items and which are supported upon the pallet 10, this providing increased efficiencies in the handling and transport of bulk volumes of articles.

Figure 4:
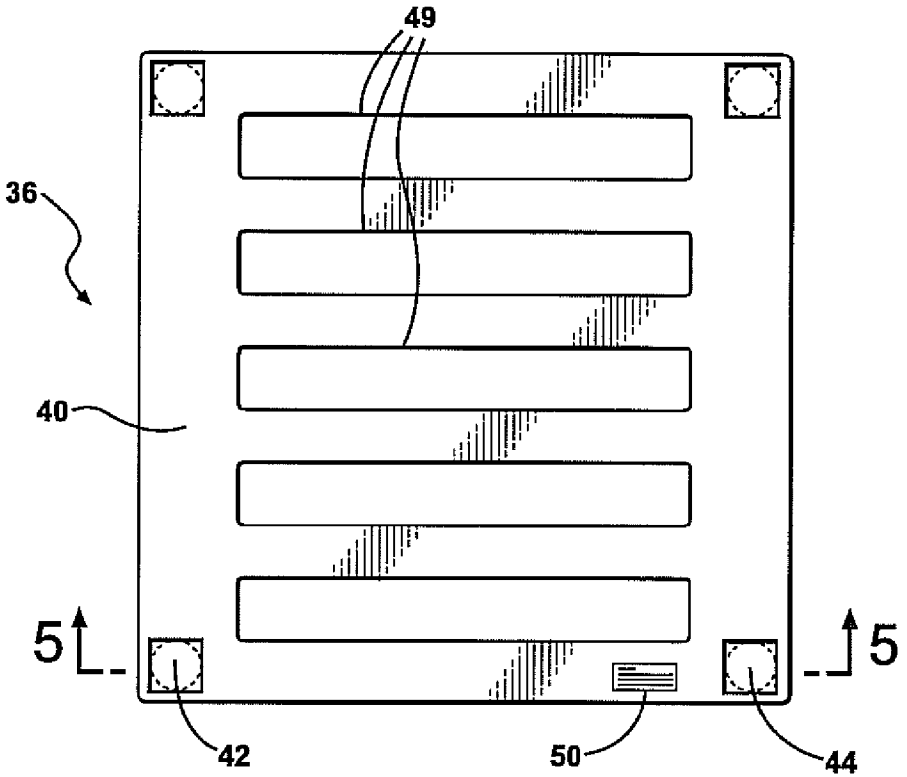
FIG. 4 is a top plan view of a composite stackable pallet construction according to a further preferred embodiment of the present inventions.
Figure 5:
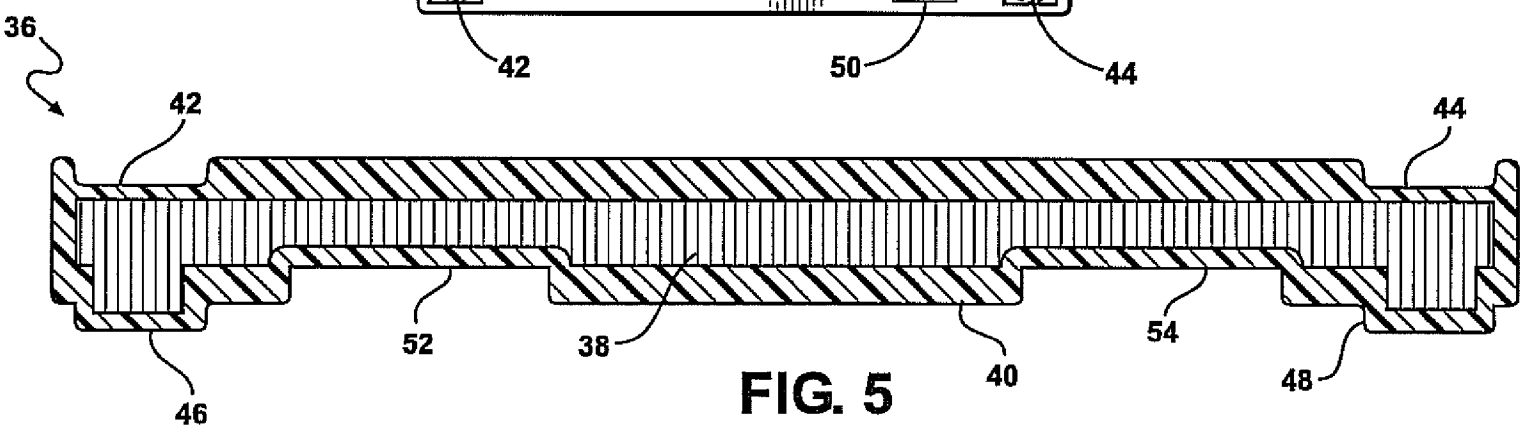
FIG. 5 is a cutaway taken along modified line 5-5 in FIG. 4 and illustrating a structural insert in the form of a durable corrugated cardboard material.

Referring collectively now to FIGS. 4 and 5, top plan and frontal cutaway views are shown at 36 of a composite stackable pallet construction according to a further preferred embodiment and which incorporates an alternate structural insert in the form of a durable corrugated cardboard material 38 (see in particular in the cutaway of FIG. 4 and again as opposed to the galvanized insert utilized in FIG. 1). As in the previous embodiment, a plasticized composite (again thermoform or heat/fireproof thermoset) material 40 is applied over the top, bottom and sides of the shaped insert/substrate 38 in any manner and according to a desired thickness so that the insert 38 is fully encapsulated. As will again be further described and explained, the corrugated insert can exhibit any desired shape or configuration the purpose for which being to increase the rigidity and durability of the pallet when overmolded with the desired plastic composite and so that the completed assembly provides greatly increased weight supporting and integrity retaining characteristics.

Referring again to FIGS. 4 and 5, corner or opposite edge extending seating locations are again defined, see as generally shown by upper (recessed) seating locations 42 & 44 and associated lower (projecting) locations 46 & 48. As shown in FIG. 4, a series of four discrete and corner located portions are referenced for providing positional location and seating engagement of stackable pallets, such as when stored and not in use.

As also shown in FIG. 4, the individual corner locations can include upwardly configured inner pockets or projections, this in order to more securely fit or seat with associated lower face locations associated with a succeeding pallet being stacked thereupon. Also illustrated is the provision of an interior grill or ribbed configuration associated with the pallet 36 (see again linear disposed and open channels or slots 49, the dimensions of which are again defined by the inner closed perimeter edges associated with both the spacing between associated cross members or ribs, as well as an associated thickness of an over-molded plastic composite), this again serving to reduce the overall material content and weight of the pallet, and while retaining most or all of its structural load bearing capabilities.

Features previously illustrated such as built in Rfid identifier chip, see at 50 in FIG. 4, are again provided. According to one known application, the use of a heavy duty corrugated paperboard material as a structural supporting insert associated with a standard 4×4' pallet exhibiting 3"-5" in varying thickness, can exhibit upwards of at least twelve thousand pounds (or more) of non-deflecting load bearing capability, this making it a very suitable and inexpensive/easily available material for use in the pallet construction.

Again illustrated in FIG. 5 is the provision of underside fork receiving recess configurations, see at 52 and 54, and for facilitating movement of a selected (loaded) pallet or stacked pallets. Additionally, and according to one non-limiting preferred embodiment, the dimensions of the overall pallet 36 can exhibit such as 40"×48", with other larger and smaller sized configurations also being envisioned according to the desired application.

Figure 6:
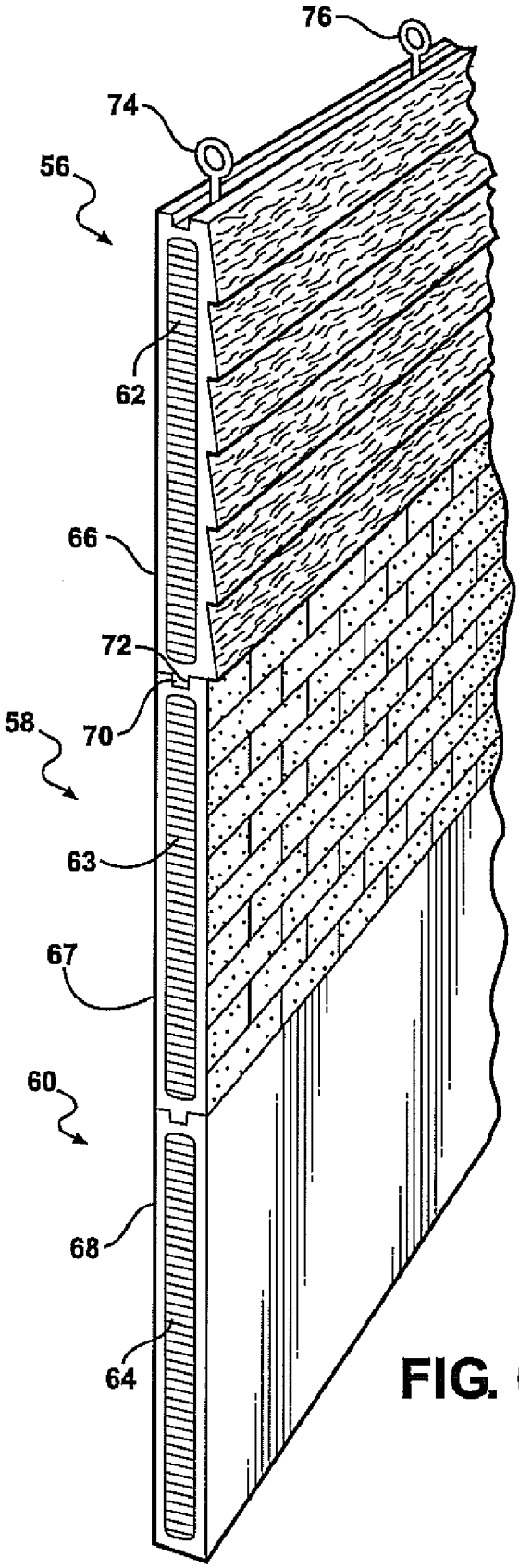
FIG. 6 is a perspective illustration of a pair of three dimensional and planar shaped articles, similar in regards to that shown in FIG. 5, and further illustrating edge extending interlock portions for erecting a height/width extending wall.

Referencing now FIG. 6, is a perspective illustration is generally shown of a plurality of three dimensional and planar shaped articles 56, 58 and 60 in stacked and height defying fashion. The articles 56, 68 and 60 are structurally similar to the composite pallet designs illustrated at 10 in FIG. 1 and at 36 in FIG. 4, with each of the planar articles, 56, 58 and 60 including an inner substratum or structural insert, see at 62 for article 56, at 63 for article 58, and further at 64 for article 60. In the embodiment illustrated, the structural inserts 62, 63 and 64 are each again provided as a corrugated cardboard material, and over which is molded a composite polymeric (thermosetting or thermoplastic) material, further at 66, 67 and 68, respectively.

The articles 58, 59 and 60 in this embodiment do not exhibit the apertured or grilled arrangement associated with the pallet designs of the previous embodiment, but rather disclose interlocking and widthwise extending/height defining articles for establishing a building structure or wall. Along these lines, edge extending interlock portions (see at 70 and 72 between selected opposing edges of articles 56 and 58 in FIG. 6) are established for erecting the height/width extending structure as shown overall.

The interlock portions can be configured along either or both of upper & lower, as well as side to side edges (not shown) of each panel article, e.g. again at 58, 59 and 60, with the interlock portions (again at 70 and 72) including a tab and slot or other seating configuration for securely installing and supporting a panel atop or aside a previously installed and supported panel. Along these lines, other supporting and securing structure (also not shown) can be employed for engaging the panels together, with the provision of additional braces, supports, footings and other means for interlocking the components together in secure fashion.

Figure 7:
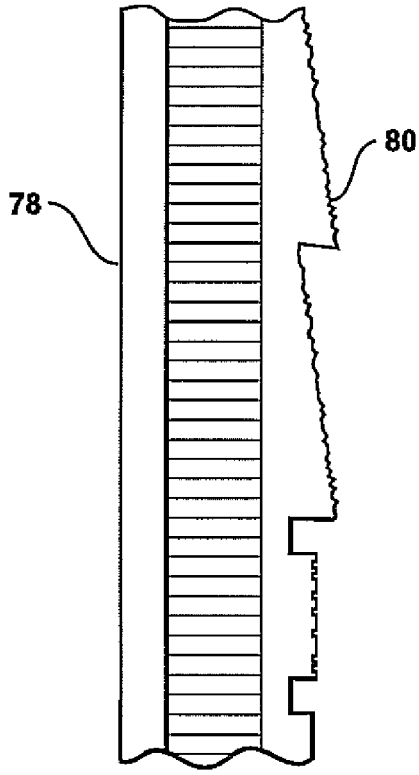
FIG. 7 is a side view of a selected wall article and exhibiting a textured faux ceramic or like design feature.

Also shown in FIG. 6 is the provision of a pair of eyelet/lift bolts, at 74 and 76, these being associated with an upper extending surface of a top most selected panel (at 58 in FIG. 6), and which can be releasably engaged to any given panel (such as through the provision of durable screw threaded plates or other such structure). Lift cables (not shown) can be attached to the eyelet bolts 74 and 76, and by which the panel (or multiple engaged panels as at 56, 58 and 60) can be lifted and positioned in place by a crane for subsequent engagement (vis-à-vis an associated interlock system of similar construction established between the adjoining sides and edges of the panels). As further shown in the side view of a selected wall article 78 in FIG. 7, also exhibited is a textured faux ceramic or lie design feature, see further at 80, and such as which is associated with a faux concrete or brick wall.

Figure 8:
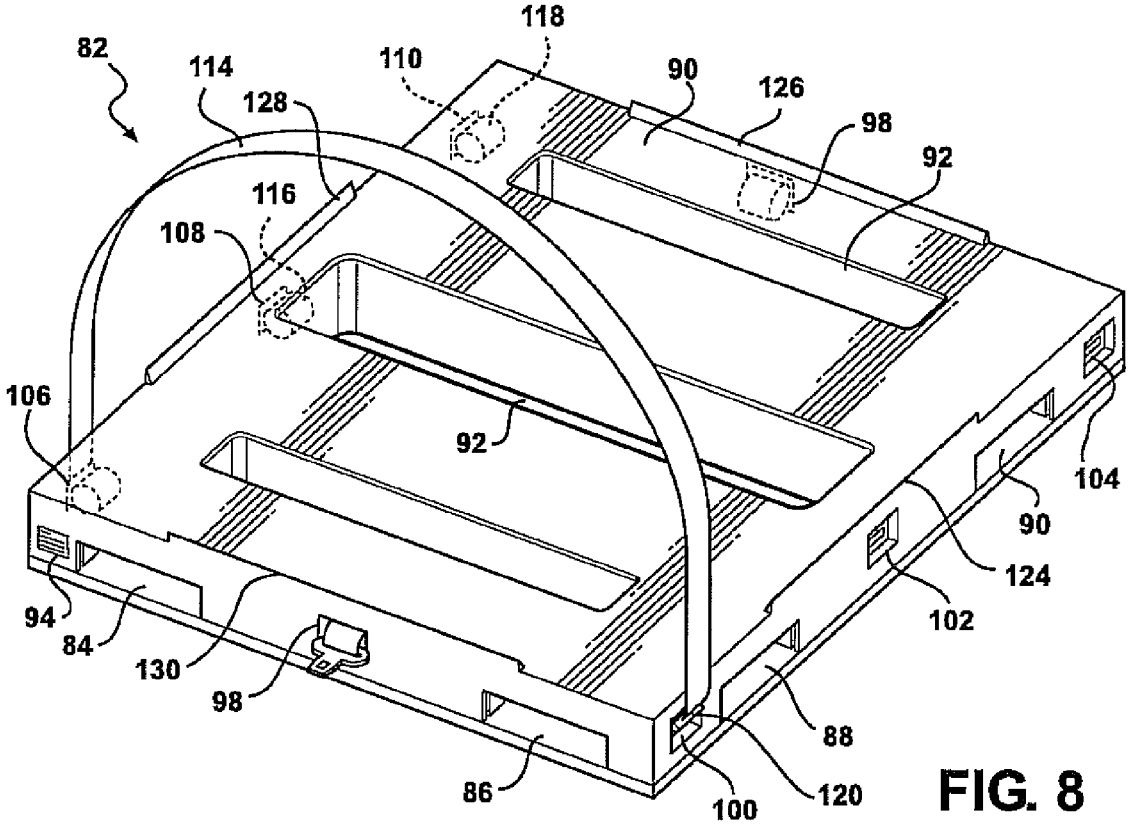
FIG. 8 is a perspective view of a composite pallet construction according to a further preferred embodiment and exhibiting the features of engageable forklift apertures and attachable strap locations for hold-down of supported items.

Referring now to FIG. 8 is a perspective view is shown at 82 of a composite pallet construction according to a further preferred embodiment and exhibiting the features of engageable forklift apertures, see at 84 & 86 along a frontal side and further at 88 & 90 along an interconnected side. The forklift apertures differ from those disclosed in previous embodiments in that these can extend as both lengthwise and widthwise interiorly configured and interlocking apertures within the interior core of the pallet body, thus decreasing the weight and material content requirement of the pallet but without affecting its weight supporting ability.

The pallet construction 82 includes a number of features also drawn from previous disclosed embodiments, such as again including the provision of a structurally supporting insert (not shown), an over-molded composite polymeric material 90, and a series of interiorly defined slots or channels 92 for reducing the material component and weight associated with the pallet construction, and again without any serious compromise to its structural rigidity. Other features repeated from earlier embodiments again include such as an Rfid tag 94 embedded or otherwise secured within a side location of the pallet and in order to provide on-site identification of components supported upon the pallet.

Figure 9:
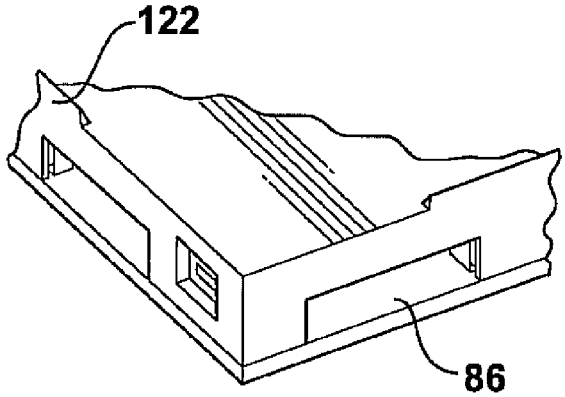
FIG. 9 is an enlarged end profile of the pallet construction of FIG. 8 and further illustrating the feature of an edge extending upper rim for providing an additional element of positional support to items placed upon the upper surface.
Figure 10:
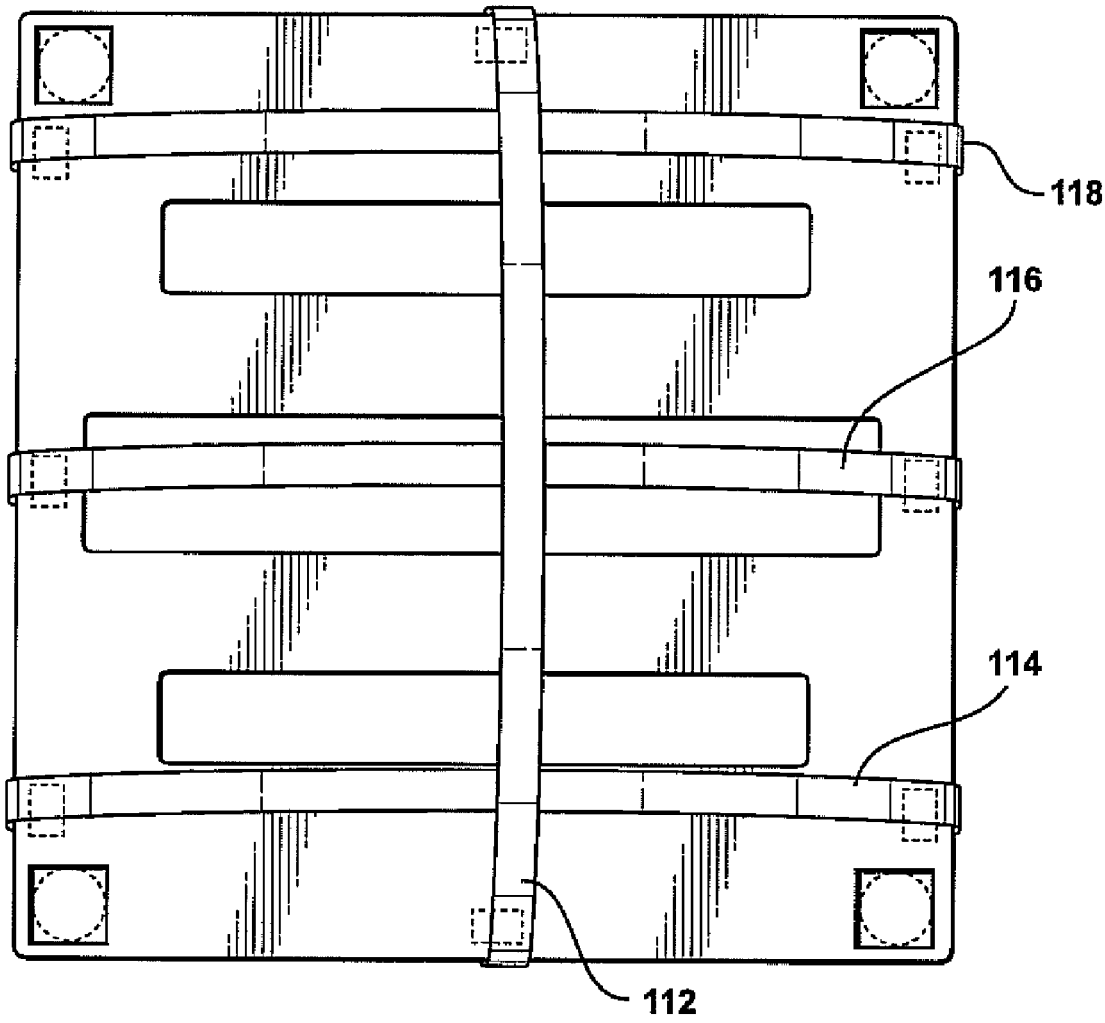
FIG. 10 is an overhead view of a pallet construction such as shown in FIG. 8 and with a plurality of straps engaged in both width-wise and end-wise extending fashion.

Among additional features incorporated into the variant of FIGS. 8-10 is the provision of a strap and associated mounting location, see positioned at 96 and 98 with respect to first selected spaced apart edges. A further plurality of strap receiving locations is provided along a further interconnecting and crosswise extending side, see at 100, 102 and 104, these being engaged by extending ends of elongated straps 106, 108 and 110 extending from a further parallel spaced side as shown in FIG. 8.

The strap mounting locations are such that any number of straps can be engaged in extending fashion, such as further shown in the overhead view of the pallet construction in FIG. 10, and with a plurality of straps 112, 114, 116 and 118 engaged in both width-wise and end-wise extending fashion between the strap mounting locations established along the four interconnecting sides of the pallet. The individual strap mounting locations (again as best shown at 100, 102 and 104 in FIG. 8) associated with any selected pallet side edge can be configured with a receiving clip portion (see at 120 for strap location 100) for releasably mounting the individual straps thereto. Alternately, the straps can also each include an otherwise shaped engaging portion which can be encapsulated or otherwise in-molded into the associated side disposed location of the pallet. In this fashion, the attachable and extendable straps, such as ratchet tie down straps, can be provided in an integral (built-in) variant or as an easily engagable component for hold-down of supported items (not shown) upon the pallet 82.

Referring to FIG. 9, an enlarged end profile of a pallet construction, similar to that in FIG. 8, further illustrates the feature of a corner edge extending upper rim, see at 122, this providing an additional element of positional support to items placed upon the upper surface of the pallet Referring previously to FIG. 8, a series of four intermediately positioned and edge extending raised rims are shown at 124, 126, 128 and 130 in a slightly alternate variant and which, in either instance, provide for positional support of cargo items supported on the pallet, and to resist the lateral sliding or displacement of such items from the upwardly planar support surface established. The raised rims (according to either variant) are typically in-molded as part of the polymeric composite covering material and can exhibit any desired pattern, profile or arrangement including the angled/tapered profile shown.

Figure 11:
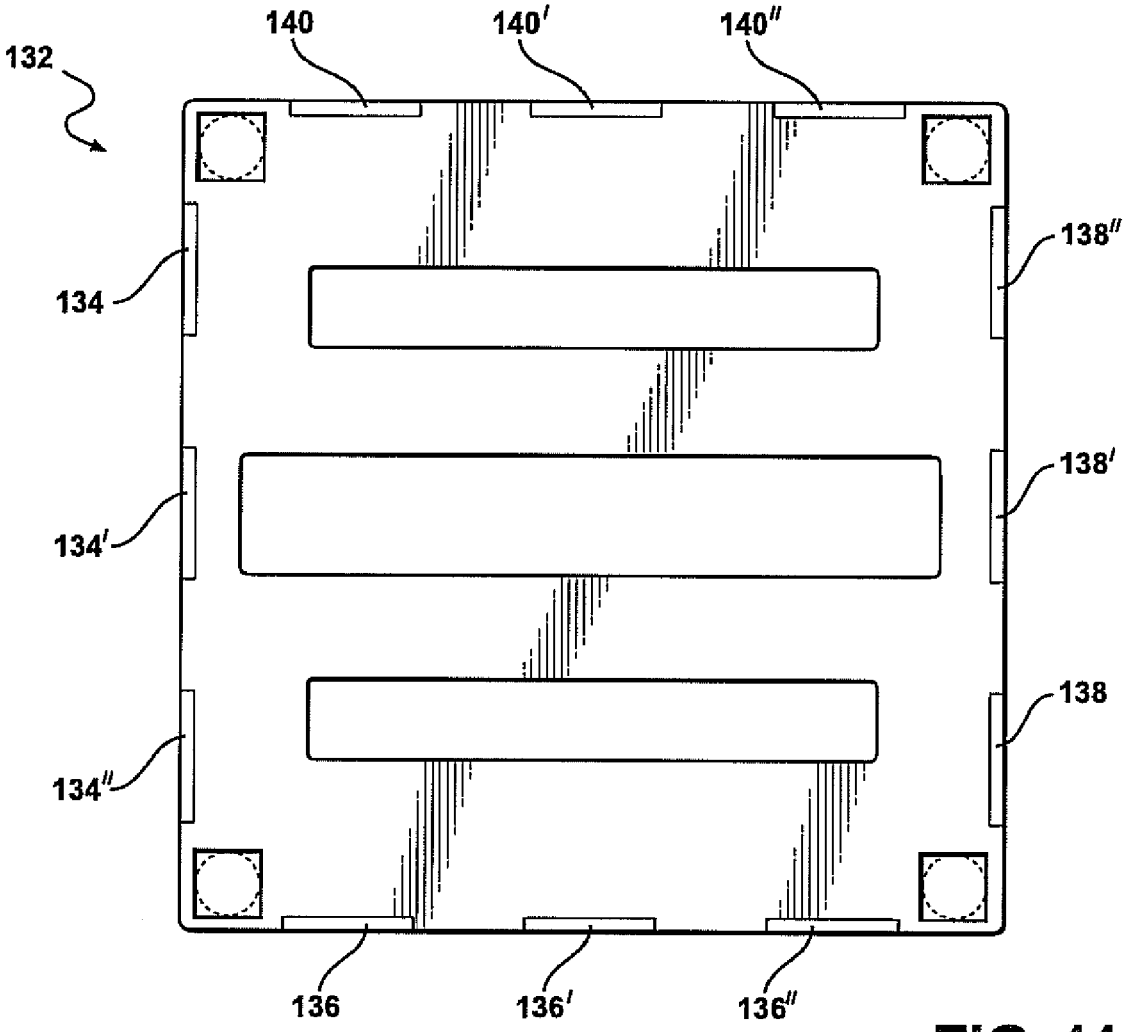
FIG. 11 is an overhead view of a further modified pallet construction and illustrating respective pluralities of three edge extending and raised rim portions extending along each side thereof.

Referring to FIG. 11, an overhead view is shown at 132 of a further modified pallet construction, this illustrating respective pluralities of three edge extending and raised rim/lip portions, see at 134, 134', 134", 136, 136', 136", 138, 138', 138", and 140, 140', 140", respectively, extending along each side thereof. The pallet construction is otherwise generally similar to those previously described.

Figure 12:
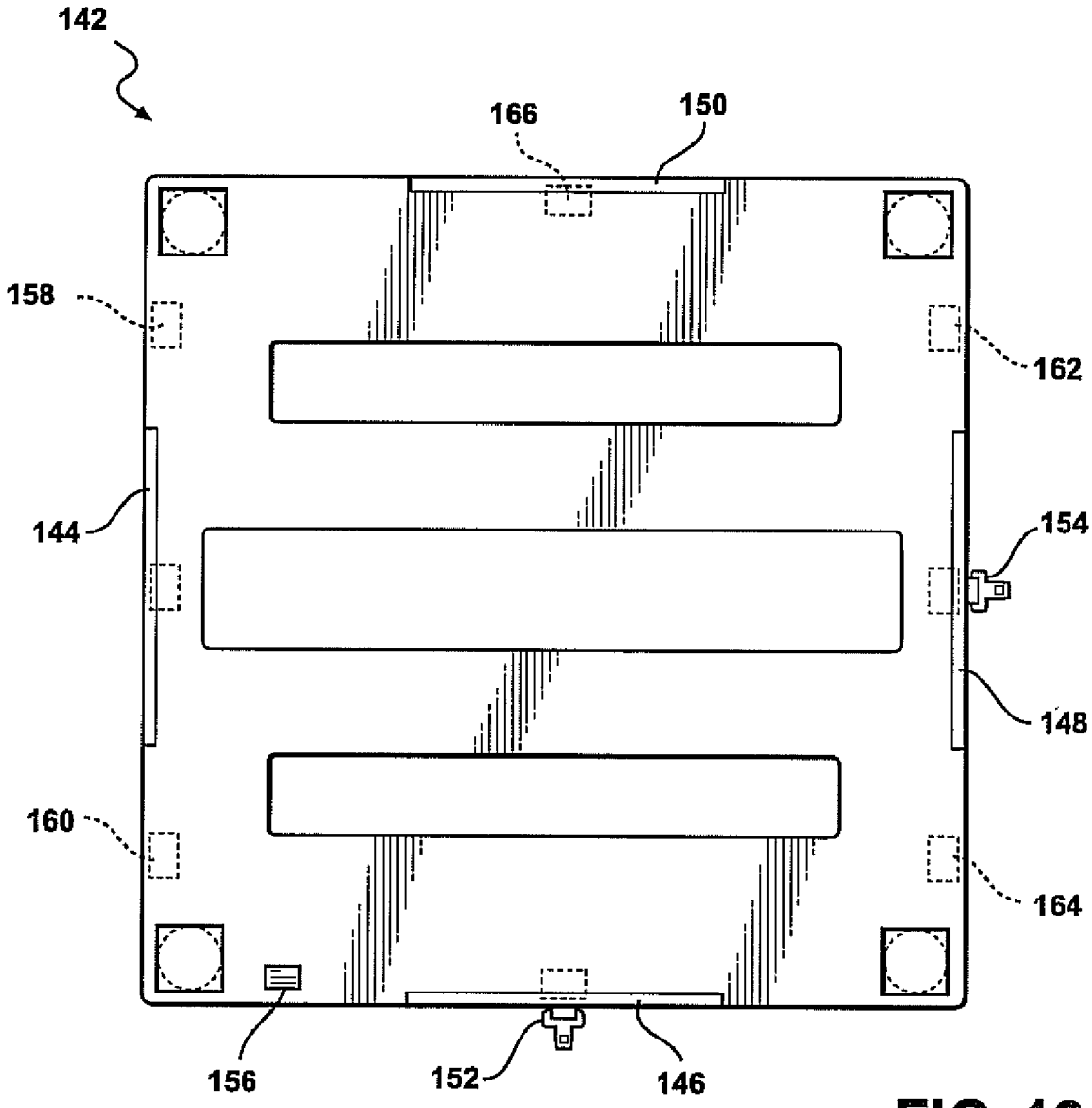
FIG. 12 is a yet further related configuration in which single center extending upper raised rim edges are configured along each of the interconnected extending sides and along with in-encapsulated strap mounting and engaging end receiving locations, as well as again the provision of a radio frequency protocol identification chip either in-molded or secured to a respective location along an edge of the pallet.

Referencing FIG. 12, a yet further related pallet configuration is generally shown at 142 of further variant, and in which single center extending upper raised rim edges 144, 146, 148 and 150 are configured along each of the interconnected extending sides. Encapsulated strap mounting locations 152 and 154 cooperate with associated opposite end mounting locations, see for example at 166 for strap 152. The provision of a radio frequency protocol identification chip is again shown at 156 and is either in-molded or secured to a respective location along an edge of the pallet. Additional strap receiving locations are also generally shown at 158 and 160 along a first extending side, at 162 and 164 along an opposite and parallel extending side, and again at 166 along a selected end 166 (such as for engaging an extending end of the strap 152).

Figure 13:
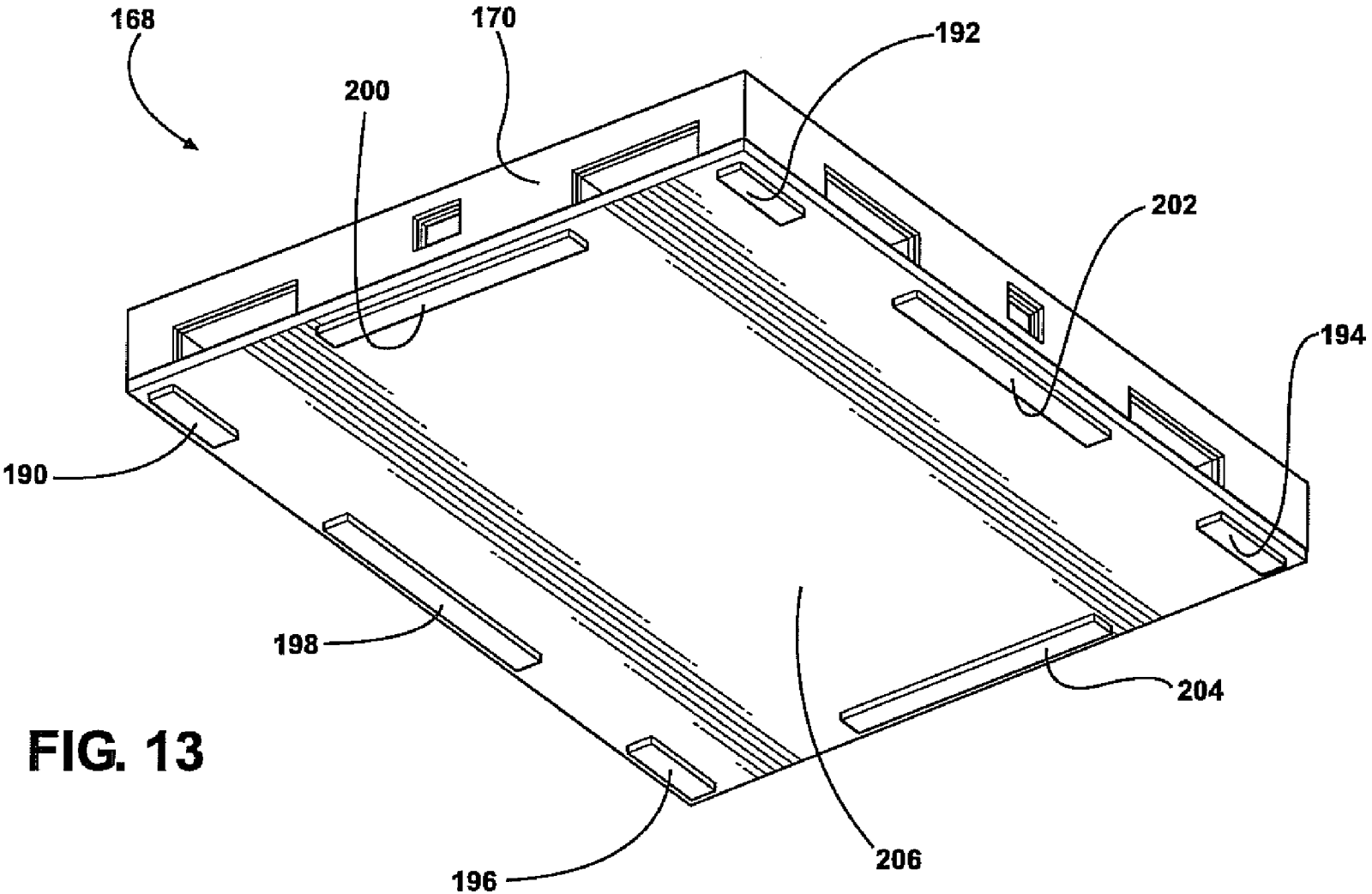
FIG. 13 is an underside assembled perspective view of a pallet construction according to a further preferred embodiment of the present invention.
Figure 14:
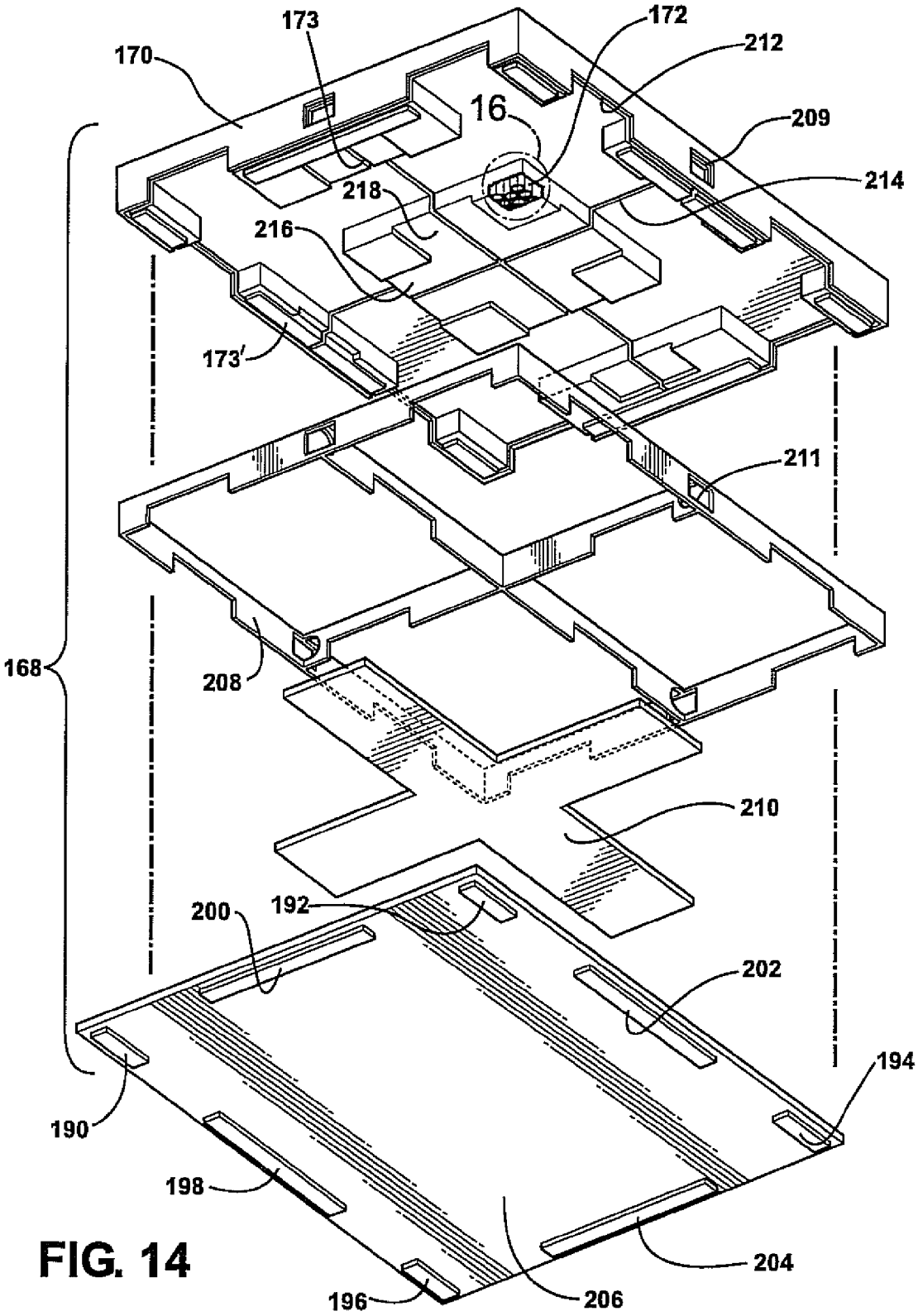
FIG. 14 is an exploded perspective view of the pallet shown in FIG. 13 and further illustrating the main pallet body with optional attachable bottom section, these sandwiching therebetween the galvanizing insert and cross shaped reinforcing support.

Referring now to FIG. 13, an underside assembled perspective view is shown at 168 of a pallet construction according to a further embodiment. As further shown in the exploded perspective view of FIG. 14, the pallet includes a main pallet body 170 exhibiting a desired shape (such as four sided square or rectangular).

Figure 16:
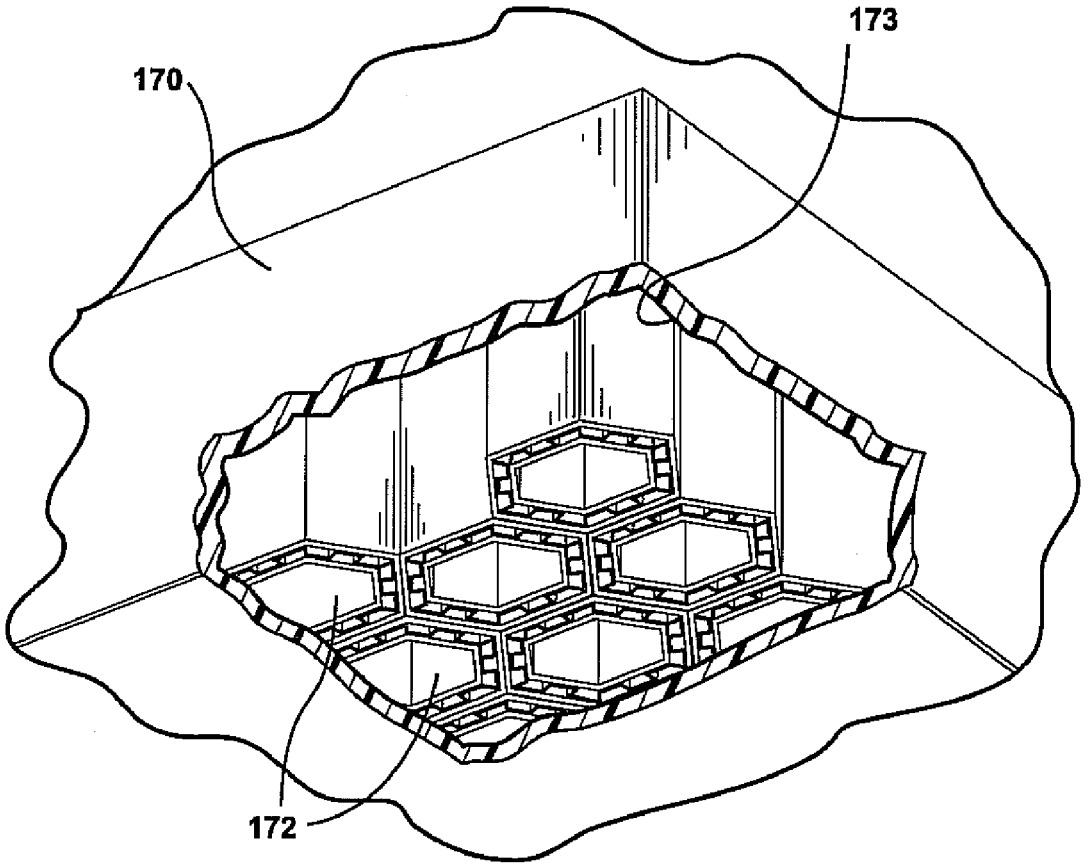
FIG. 16 is an enlargement, in cutaway, of a portion of the main pallet body and further showing the honeycombed nature of the corrugated and reinforcing insert encapsulated within the main body.

FIG. 16 is an enlargement, in cutaway, of a portion of the main pallet body 170 and further showing the honeycombed nature of a plurality of corrugated and reinforcing insert defining portions, see at 172, and which are encapsulated within the main body 170 by the over-molding of a desired composite plasticized construction of desired thickness, see further at 173. The reinforcing insert portions 172 are illustrated as a plurality of interconnected modified or pseudo-cylinder shaped articles, these each having a six (hex) sided shape and extending in downward fashion as shown.

It is also understood and envisioned that the corrugated insert can provide any desired open or closed profile, such as in order to enhance the performance characteristics of the pallet construction. As further shown in the underside exploded view of FIG. 14, the corrugated portions 172 are illustrated at a generally central underside of the main pallet body 170, it being understood that additional pluralities of corrugated portions (not shown) can be alternatively and/or additionally positioned at outer perimeter locations such as representatively shown at 173 and 173'.

The main pallet body 170 further is shown with a unique four sided configuration, this further including a first top surface pattern of recesses, see at 174, 176, 178 and 180, as well as a second alternating top surface pattern 182, 184, 186, 188. Both recess patterns are shown extending along locations proximate the outer edges of the associated pallet sides and matingly engage in stacked fashion with bottom projecting surface patterns 190, 192, 194, and 196, as well as additional projecting surface patterns 198, 200, 202 and 204, these being defined along corresponding outer perimeter edges of a bottom attachable section 206. The bottom attachable section 206 can optionally be constructed of either a metal or composite plastic material and secures to the underside surface of the main pallet body 170, such as through the provision of clips, fasteners, adhesives, chemical bonding, molding or the like (not shown), and can assist in dispersing the loading forces exerted downwardly from the main pallet body 170, as well as providing a level surface for supporting the pallet, such as upon a conveyor or the like.

As further shown in FIG. 13, sandwiched between the main pallet body 170 and the bottom attachable section 206 are a galvanizing and generally rectangular/grid shaped insert 208 and a planar/cross shaped reinforcing support 210. The galvanized insert 208 includes a four sided shape with a pair of inner crosswise and grid extending portions, these being configured to seat within a likewise shaped and interconnecting recessed pattern, see as shown by example at 212 and 214, defined along the edge and inner extending undersides of the pallet body 170. Both the sides of the pallet body 170 and the matching insert 208 include aligning strap receiving locations, see for example as shown at 209 and 211 on selected matching sides in FIG. 14. In this fashion, the galvanized insert seats through the underside of the main pallet body and, in combination with the corrugated reinforcing portions 172, adds extra strength to the pallet. Additional to a galvanized (anti-rusting) composition, it is also envisioned and understood that other material constructions can be provided for the reinforcing insert 210.

Figure 15:
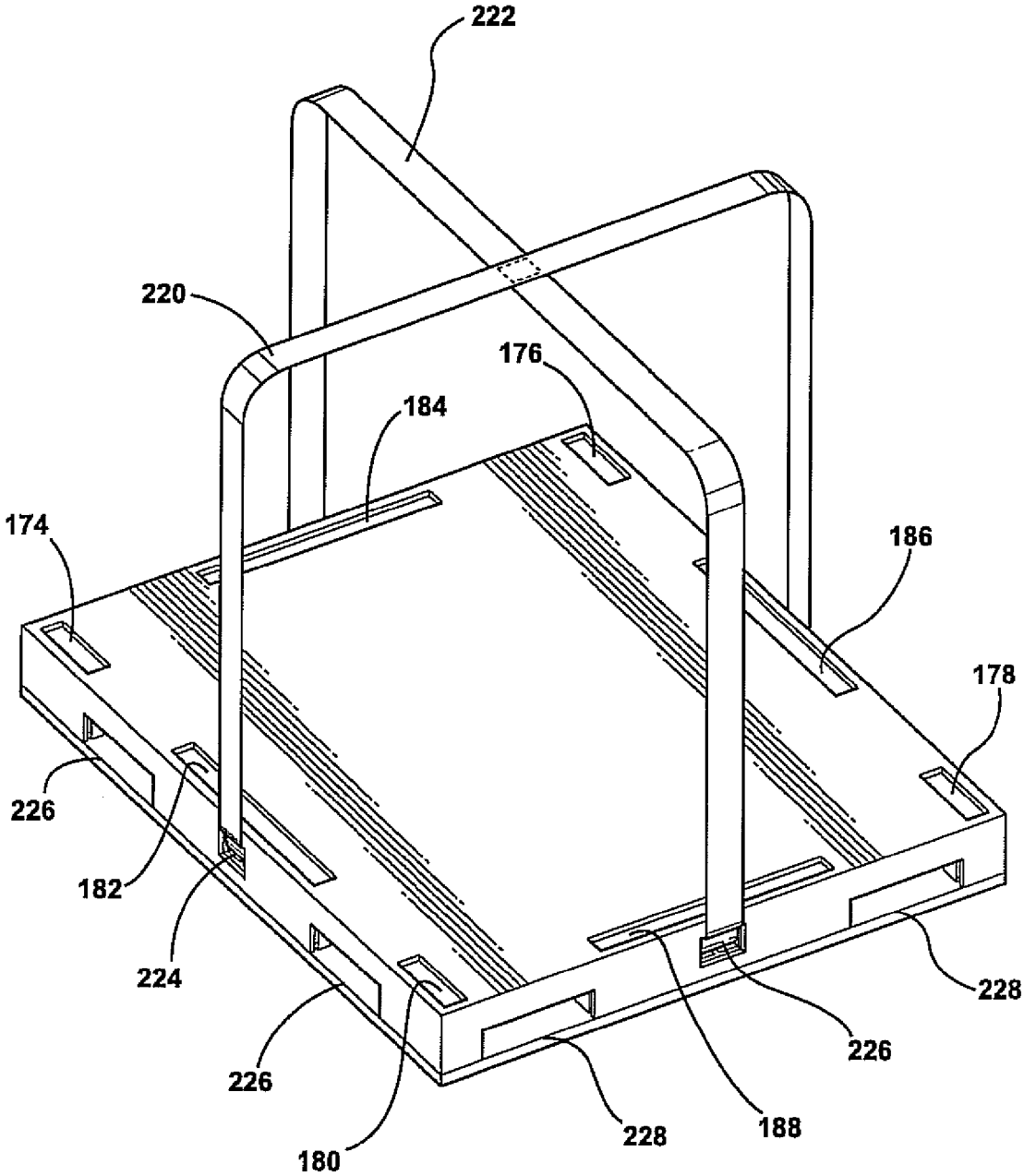
FIG. 15 is an upper side perspective view of the pallet in FIG. 13 and further illustrating the crosswise extending straps extending upwardly from the sides of the pallet.

The planar/cross shaped reinforcing support 210 secures against an underside of the planar shaped body 170, in particular seating within crosswise tracks 216 and 218 defined in the central underside of the main pallet body 170 as shown in FIG. 13, and to provide further reinforcing support to the pallet. Finally, and referring to FIG. 15 an upper side perspective view is shown of the pallet in FIG. 13 and further illustrating provision of crosswise extending straps, see generally at 220 and 222, extending upwardly from locations 224 and 226 associated with sides of the pallet. Additional forklift engaging apertures are shown at 226 and 228 and which operate in a similar fashion as described in reference to earlier preferred embodiments.

Having described my invention, other and additional preferred embodiments will become apparent to those skilled in the art to which it pertains, and without deviating from the scope of the appended claims.

I claim:

1. A reinforced pallet, comprising:

a main body having a three dimensional and generally planar shape and size and including a core material constructed of at least a heavy paperboard surrounded by a composite plastic coating;

a four sided galvanizing frame insert exhibiting a pair of inner crosswise extending portions and which seats within aligning recesses defined along underside extending edges of said main body;

a cross shaped reinforcing support exhibiting a substantially flattened profile and seating within crosswise tracks defined within a central projecting underside of said main body; and a bottom section generally corresponding in outline to said main body and affixing over said galvanized frame and reinforcing insert.

2. The pallet as described in claim 1, said core material further comprising a plurality of corrugated and reinforcing insert defining portions.

3. The pallet as described in claim 2, said corrugated and reinforcing insert defining portions further comprising a generally honeycombed and modified cylindrical extending shape.

4. The pallet as described in claim 1, said main body exhibiting a first pattern of mating portions defined on a top surface, said bottom section exhibiting a second pattern of mating portions on a bottom surface.

5. The pallet as described in claim 4, said first and second patterns further comprising opposing patterns of recessed portions and projecting portions for stacking a first pallet upon a second pallet.

6. The pallet as described in claim 1, further comprising a plurality of strap receiving locations associated with a plurality of sides of said body.

7. A reinforced pallet, comprising:

a four sided structural substrate including one of a galvanized steel or corrugated cardboard exhibiting a specified shape and size and which is coated with a plasticized material according to a built up thickness, said substrate including a first plurality of interconnecting outer members and a further plurality of parallel and spaced apart inner members extending between selected and parallel spaced outer members to define a structural supporting interior of said substrate;

a plurality of recessed corner locations defined in an upper surface of said substrate; and a further plurality of downwardly projecting corner seating locations defined in a lower surface of said substrate and which are adapted to seat within said plurality of upper surface corner locations associated with a second substrate in a non-use stacking arrangement.

8. The pallet as described in claim 7, said inner members each further comprising a substantially "T" shape in cross section.

9. The pallet as described in claim 7, said structural substrate with said plasticized material exhibiting spaced apart and underside extending recesses adapted for receiving inserting lift forks.

10. The pallet as described in claim 7, further comprising a radio frequency identification tag embedded into said plasticized material coating said structural substrate.

11. The pallet as described in claim 7, said plasticized material further comprising at least one of a heat/fire proof thermoset or thermoplastic material within which is entrained a natural or synthetic aggregate.

12. A composite pallet, comprising:

a four sided and substantially flattened and structurally supporting insert body exhibiting a plurality of material and weight reduction channels defined in spaced apart fashion along and within an interior of said body;

a plasticized coating material applied over said insert according to a built up thickness;

pluralities of lift fork receiving apertures defined along each of said four sides;

at least one elongated strap mounted in rotary unwinding fashion within at least one exposed and selected side of said body, at least one strap receiving clip portions mounted in exposed fashion along at least one further selected and opposite side of said body such that, upon unwinding, said elongated strap in extending fashion over an upper structurally supporting surface of said body an extending end thereof engages with said clip portion.

13. The pallet as described in claim 12, further comprising a radio frequency identification tag embedded into said plasticized material coating said structurally supporting body.

* * * * *